US007967428B2

(12) United States Patent
Seino et al.

(10) Patent No.: US 7,967,428 B2
(45) **Date of Patent: *Jun. 28, 2011**

(54) METHOD OF MANUFACTURING A LIQUID CONTAINER INCLUDING A CHECK VALVE AND BYPASS FLOWING PASSAGE, AND LIQUID CONTAINER INCLUDING SAID CHECK VALVE AND BYPASS FLOWING PASSAGE

(75) Inventors: Takeo Seino, Nagano-ken (JP); Hitotoshi Kimura, Nagano-ken (JP); Taku Ishizawa, Nagano-ken (JP); Yasunao Uehara, Nagano-ken (JP); Masahide Matsuyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 670 days.

This patent is subject to a terminal disclaimer.

(21) Appl. No.: 11/866,118

(22) Filed: Oct. 2, 2007

(65) Prior Publication Data

US 2008/0030558 A1 Feb. 7, 2008

Related U.S. Application Data

(63) Continuation of application No. 11/040,232, filed on Jan. 21, 2005, now Pat. No. 7,293,863.

(30) Foreign Application Priority Data

Feb. 16, 2004 (JP) ..... 2004-038021

(51) Int. Cl.
*B41J 2/175* (2006.01)

(52) U.S. Cl. ..... 347/86; 347/85

(58) Field of Classification Search ..... 347/85, 347/86; 215/21; 604/191
See application file for complete search history.

(56) References Cited

U.S. PATENT DOCUMENTS

| | | | | |
|---|---|---|---|---|
| 2,076,668 | A | | 4/1937 | Read |
| 2,380,825 | A | * | 7/1945 | Diaz ..... 215/21 |
| 3,550,616 | A | | 12/1970 | Graham et al. |
| 4,020,978 | A | | 5/1977 | Szczepanski |
| 5,993,425 | A | * | 11/1999 | Kriesel ..... 604/191 |
| 6,017,332 | A | | 1/2000 | Urrutia |
| 6,172,694 | B1 | | 1/2001 | Droege et al. |

(Continued)

FOREIGN PATENT DOCUMENTS

EP 1 380 428 A2 1/2004

(Continued)

*Primary Examiner* — Stephen D Meier
*Assistant Examiner* — Carlos A Martinez, Jr.
(74) *Attorney, Agent, or Firm* — Stroock & Stroock & Lavan LLP

(57) ABSTRACT

Since a bypass flowing passage which communicates with the inside of a bag part not through a second valve mechanism is provided for an outlet part, ink can be filled from the outlet part into the bag part in spite of the existence of the second valve mechanism. Further, after an empty ink pack has been housed in an inner case, the ink is filled into the ink pack. Therefore, when a first seal film is welded to the inner case, since the bag part is not bulky, the ends of the bag part are caught in a cartridge case. Therefore, the maximum amount of ink for the inner volume of the cartridge case can be filled. Further, since a bypass flowing passage is blocked after the ink has filled into the ink pack, contamination of air bubbles into the bag part through the bypass flowing passage is prevented.

6 Claims, 7 Drawing Sheets

U.S. PATENT DOCUMENTS

| | | | | |
|---|---|---|---|---|
| 6,843,558 | B2 | 1/2005 | Seino | |
| 7,293,863 | B2 * | 11/2007 | Seino et al. | 347/85 |
| 2002/0196312 | A1 | 12/2002 | Ishizawa et al. | |
| 2004/0056934 | A1 | 3/2004 | Seino | |
| 2004/0217127 | A1 | 11/2004 | Kimura et al. | |

FOREIGN PATENT DOCUMENTS

| | | |
|---|---|---|
| JP | 2002-192739 | 7/2002 |

* cited by examiner

METHOD OF MANUFACTURING A LIQUID CONTAINER INCLUDING A CHECK VALVE AND BYPASS FLOWING PASSAGE, AND LIQUID CONTAINER INCLUDING SAID CHECK VALVE AND BYPASS FLOWING PASSAGE

CROSS-REFERENCE TO RELATED APPLICATION

This application is a continuation of copending application Ser. No. 11/040,232, filed on Jan. 21, 2005.

BACKGROUND OF THE INVENTION

The present invention relates to a method of manufacturing a liquid container, and a liquid container.

As a liquid jet apparatus which jets liquid to a target, an ink jet type recording apparatus has been known widely. Specifically, this ink jet type recording apparatus includes a carriage, a recording head mounted on the carriage, and an ink cartridge which contains ink as liquid therein. While the carriage is being moved in relation to a recording medium, the ink is supplied from the ink cartridge to the recording head, and the ink is ejected from a nozzle formed in the recording head, whereby printing is performed on the recording medium.

In such the ink jet type recording apparatuses, there is an apparatus in which an ink cartridge is not mounted on a carriage in order to reduce load onto the carriage or to reduce size/thickness of the apparatus (so-called Off-carriage type).

Such the ink cartridge includes usually an ink pack which contains ink therein, and a case which houses the ink pack.

As such the ink pack, an ink pack having a valve unit at an outlet part has been known (refer to, for example, Patent Reference 1). Specifically, this outlet part is provided so as to be interposed in an opening constituting a bag part of the ink pack, and discharges the ink contained in the bag part to the outside. The valve mechanism provided for this outlet part functions as a check valve that permits only the outflow from the inside of the ink pack to the outside.

In case that the ink is supplied from the ink pack provided with this outlet part to the recording head, firstly, into the outlet part, an ink introducing pipe is inserted, which is provided for one end of an ink supply tube of which the other end is coupled to the recording head. Thereafter, by crushing the bag part, the pressure of the ink in the ink pack is increased. In result, the ink in the ink pack is supplied through the outlet part and the ink supply tube to the recording head.

In the ink pack provided with this outlet part, even if a user opens forcedly a leading-end-side opening part of the outlet part with a screw driver, the valve unit functions as the check valve. Therefore, it is prevented that the ink in the ink pack leaks out to the outside or the external air flows into the ink pack. In result, deaeration and clean levels of ink in the ink pack can be improved.

Patent Reference 1: JP-A-2002-192739

However, since in the ink pack disclosed in the Patent Reference 1, the valve unit provided for the outlet part functions as the check valve, the ink cannot be poured through the outlet part.

Further, when the ink pack filled with ink is housed in the ink cartridge, there is fear that four corners of the ink pack are caught in the ink cartridge. Therefore, the maximum amount of ink cannot be filled for internal volume of the ink cartridge.

The invention has been made in view of the above problems, and its object is to provide a method of manufacturing a liquid container, and a liquid container, in which liquid can be poured from an outlet member provided with a check valve to a liquid containing part, and the amount of liquid that can filled for internal volume of a housing can be increased.

SUMMARY OF THE INVENTION

In order to solve the above problems, in a method of manufacturing a liquid container provided with a liquid storing member in which an outlet member is attached to a liquid containing part that contains liquid therein, and the liquid contained in the liquid containing part is supplied from the outlet member to the outside, and a housing which comprises a housing body and a lid member that closes the housing body, and houses the liquid storing member in the housing body, the outlet member includes a liquid flowing passage which communicates the outside and the inside of the liquid containing part, a check valve which permits only the flow of the liquid from the inside to the outside, on the liquid flowing passage, and a bypass flowing passage which bypasses the check valve and communicates the outside and the inside of the liquid containing part, on the liquid flowing passage. Further, the method comprises the steps of: housing the liquid storing member in the housing body; filling the liquid from the outside into the liquid containing part through the liquid flowing passage of the outlet member and the bypass flowing passage; and blocking, after filling the liquid into the liquid containing part, the bypass flowing passage by a blocking means.

According to the invention, by bypassing the check valve, that is, through the bypass flowing passage, the outside of the liquid containing part and the inside thereof can be communicated. Therefore, in a state where the liquid storing member is housed in the housing body, liquid can be filled into the liquid containing part. Accordingly, by filling the liquid into the liquid containing part through the outlet part after the liquid storing member has been housed in the housing body, the liquid storing body before filling is not bulky, so that the liquid containing part can be housed without sticking from the housing body, and the amount of liquid filled into the liquid containing part for the volume of the housing body can be increased. Further, since the bypass flowing passage is blocked after liquid filling, it is possible to prevent deaeration and cleaning levels of liquid from lowering due to contamination of air bubbles into the liquid containing part.

In the liquid container manufacturing method of the invention, an airtightly closing step of closing the housing body by a seal member airtightly after the step of housing the liquid storing member into the housing body is further included, the seal member has flexibility at least at its portion opposed to a blocking position where the bypass flowing passage is blocked, and the blocking means is the liquid containing part.

According to the invention, after the housing step, the housing body is closed airtightly by the seal member. Since this seal member has flexibility at least at its portion opposed to the blocking position where the bypass flowing passage is blocked, the bypass flowing passage can be blocked by the liquid containing part while the seal member is being flexed.

In the liquid container manufacturing method of the invention, regarding the seal member and the liquid containing parts, at least their surfaces opposed to each other are formed of materials which are different from each other.

According to the invention, regarding the seal member and the liquid containing parts, at least their surfaces opposed to each other are formed of materials which are different from each other. In result, for example, in case that the part of the seal member opposed to the bypass flowing passage is heated thereby to close the bypass flowing passage by the liquid containing part from the upside of the seal member, the seal member is not bonded to the liquid containing part. Therefore, by a simple method, and without adding a member for blocking, the bypass flowing passage can be blocked.

In the liquid container manufacturing method of the invention, blocking of the bypass flowing passage is performed by heat welding.

According to the invention, since blocking of the bypass flowing passage is performed by heat welding, for example, compared with blocking by vibration welding, it is possible to prevent foreign material from entering into the liquid container, and also time necessary for blocking can be reduced.

In the liquid container manufacturing method of the invention, the blocking means is a stopper fitted and fixed into the bypass flowing passage. According to the invention, since the blocking means is formed of the stopper, the bypass flowing passage can be easily blocked.

A liquid container of the invention is provided with a liquid storing member in which an outlet member is attached to a liquid containing part that contains liquid therein, and the liquid contained in the liquid containing part is supplied from the outlet member to the outside; and a housing which comprises a housing body and a lid member that closes the housing body, and houses the liquid storing member in the housing body. In the liquid container, the outlet member includes a liquid flowing passage which communicates the outside and the inside of the liquid containing part; a check valve which permits only the flow of the liquid from the inside to the outside, on the liquid flowing passage; and a bypass flowing passage which bypasses the check valve and communicates the outside and the inside of the liquid containing part, on the liquid flowing passage.

According to the invention, by bypassing the check valve, that is, through the bypass flowing passage, the outside of the liquid containing part and the inside thereof can be communicated. Therefore, in the state where the liquid storing member is housed into the housing body, the liquid can be filled into the liquid containing part. By blocking the bypass flowing passage after liquid filling, contamination of the air bubbles in the liquid containing part is prevented.

The present disclosure relates to the subject matter contained in Japanese patent application No. 2004-038021 (filed on Feb. 16, 2004), which is expressly incorporated herein by reference in its entirety.

DESCRIPTION OF THE PREFERRED EMBODIMENT

First Embodiment

Figure 1:
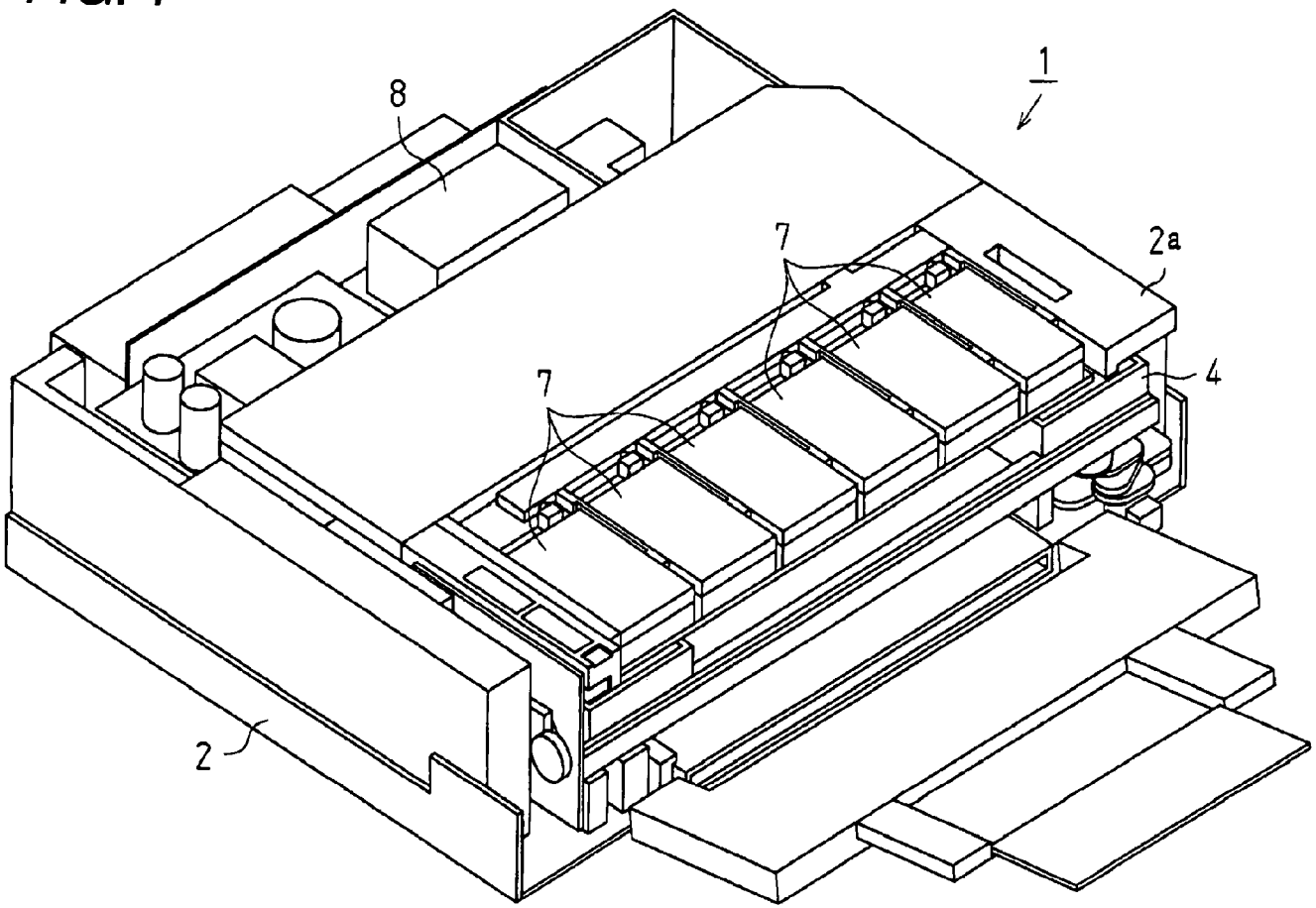
FIG. 1 is a perspective view for explaining outlines of a printer in a first embodiment.

A first embodiment of the invention will be described below with reference to FIGS. 1 to 6. FIG. 1 is a perspective view of an ink jet type recording apparatus (hereinafter referred to simply as a printer 1) used as a liquid jet apparatus in the embodiment, FIG. 2 is a main portion perspective view of the printer 1, and FIG. 3 is an exploded perspective view of an ink cartridge provided for the printer 1.

As shown in FIG. 1, the printer 1 in the embodiment is an ink jet type, and includes a frame 2. Inside the frame 2, as shown in FIG. 2, a guide member 3, a carriage 4, a recording head 5, and a valve unit 6 are provided. Further, the printer 1 is provided, as shown in FIG. 1, with an ink cartridge 7 as a liquid container, and an air pressure pump 8. The frame 2 is a box body formed generally in the shape of a rectangular parallelepiped, and has a cartridge holder 2*a* on its front surface.

Figure 2:
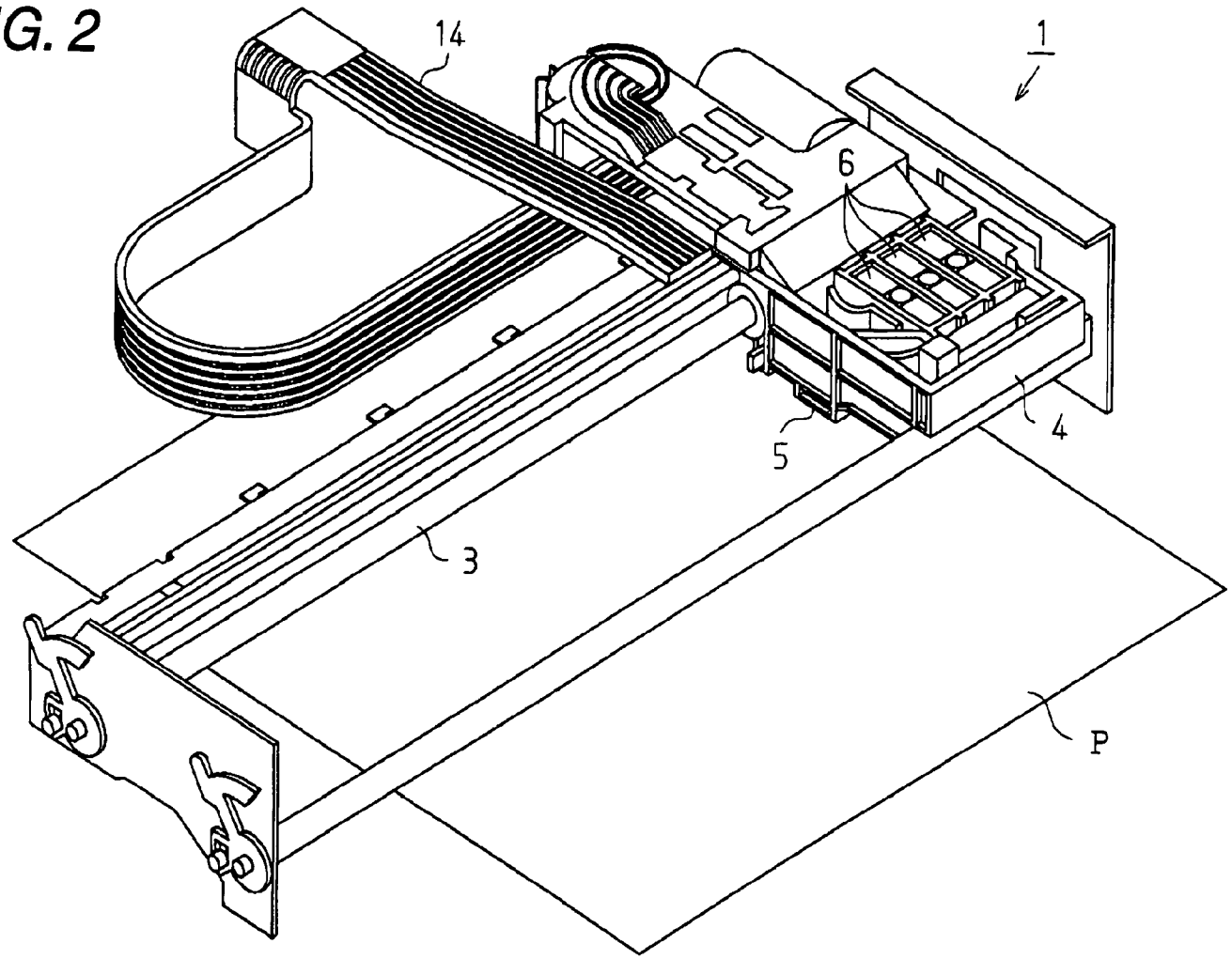
FIG. 2 is a perspective view for explaining the inner structure of the printer.
Figure 3:
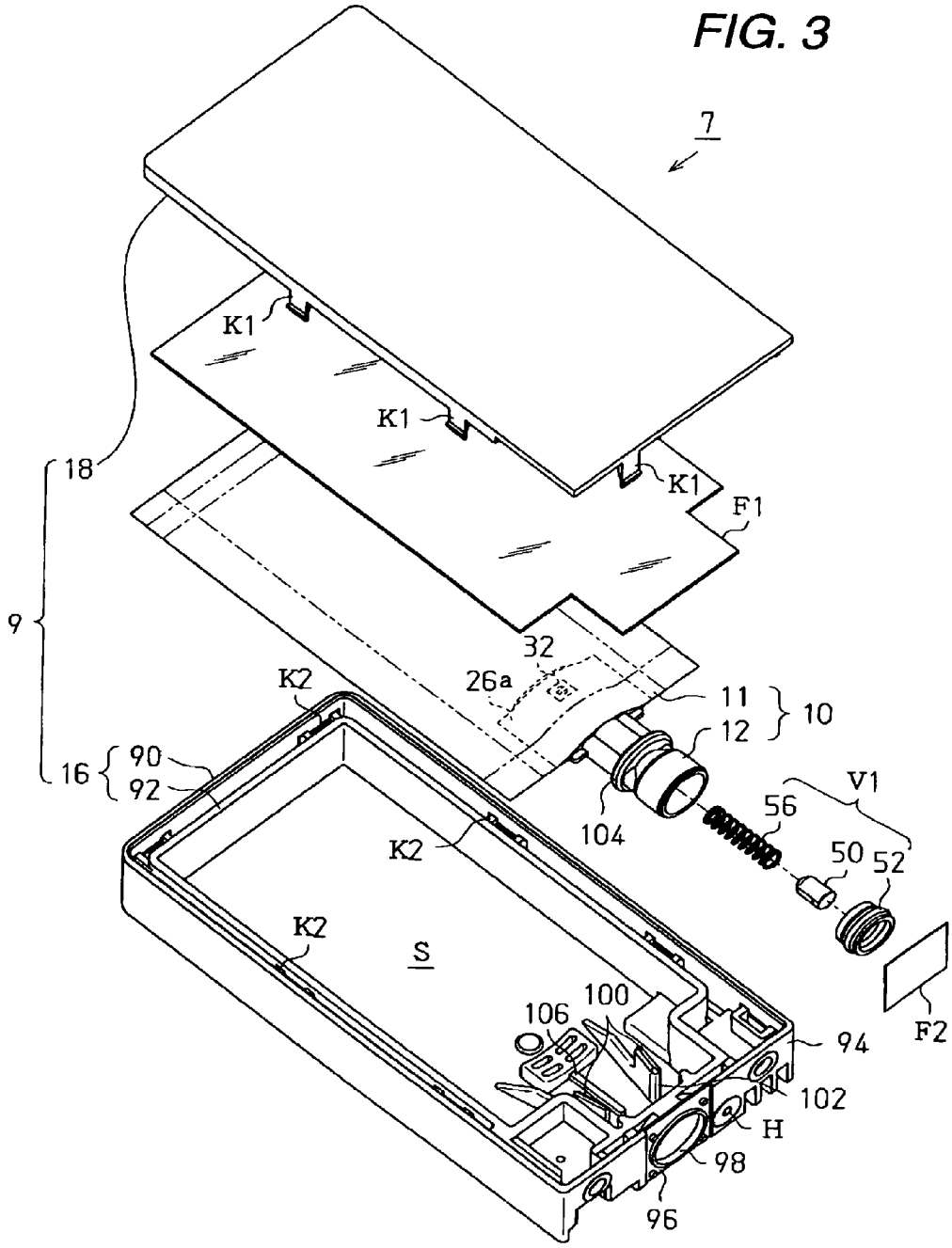
FIG. 3 is an exploded perspective view for explaining the constitution of an ink cartridge.

The guide member 3, as shown in FIG. 2, is formed in the shape of a rod, and is installed in the frame 2. In the embodiment, a direction where the guide member 3 is installed is referred to as a main scanning direction. The guide member 3 is inserted into a carriage 4 so that the carriage 4 can move in relation to the guide member 3, and the carriage 4 can reciprocate in the main scanning direction. Further, the carriage 4 is connected through a timing belt (not shown) to a carriage motor (not shown). The carriage motor is supported by the frame 2, the carriage 4 is driven through the timing belt by drive of the carriage motor, and the carriage 4 is reciprocated along the guide member 3, that is, in the main scanning direction.

On the other hand, the recording head 5 is arranged on a lower surface of the carriage 4, and includes plural nozzles (not shown) for jetting ink as liquid. The valve unit 6 is mounted on the carriage 4, and supplies temporarily stored ink to the recording head 5 in a state where the pressure is regulated.

In the embodiment, each valve unit 6 can supply, in the state where the pressure is regulated, two kinds of ink individually to the recording head 5. In the embodiment, three valve units 6 are provided in total, and they correspond to six colors (black, yellow, magenta, cyan, light magenta, and light cyan) of ink.

Further, below the recording head 5, a platen (not shown) is provided, and supports a recording medium P fed in a sub-scanning direction that is orthogonal to the main scanning direction.

As shown in FIG. 1, the ink cartridges 7 are housed detachably in the cartridge holder 2*a*, and the number of the ink cartridges 7 is six correspondingly to colors of the above ink.

This ink cartridge 7, as shown in FIG. 3, comprises a cartridge case 9 as a housing, and an ink pack 10 as a liquid storing member provided in the cartridge case 9. The ink pack 10 includes a bag part 11 as a liquid containing part which stores ink therein, in which ink is sealed. Further, the ink pack 10 includes an outlet part 12 as an outlet member, and is housed in the cartridge case 9 of the ink cartridge 7. Under this state, in the ink pack 10, a part of the outlet part 12 is exposed from the cartridge case 9, and other portions than its exposed part are housed in the cartridge case 9 in an airtight state. Further, for the cartridge case 9, an air inlet H is provided so as to communicate with space S formed between the cartridge case 9 and the ink pack 10. Under this constitution, by causing air to flow from the air inlet H, the pressure in the space S is increased, which can generate such power as to crush the ink pack 10.

On the other hand, the outlet part 12 of the ink pack 10 is connected through an ink supply tube 14 (refer to FIG. 2) provided for each color of ink to the valve unit 6. This valve unit 6, as described above, is connected to the recording head 5. By such the constitution, ink in the ink pack 10 is supplied through the ink supply tube 14 to the valve unit 6.

Further, as shown in FIG. 1, the air pressure pump 8 is fixed to the back surface side of the frame 2. The air pressure pump 8 sucks air, and can exhaust the sucked air as pressure air. Further, the air pressure pump 8 is connected through six air tubes (not shown) to the respective air inlets H (refer FIG. 3) of the corresponding ink cartridges 7.

By such the constitution, the air pressurized by the air pressure pump 8 is introduced through each air tube into the space S of the ink cartridge 7.

Consequently, when the pressure air is caused to flow into the space S from the air pressure pump 8, and the ink pack 10 of each ink cartridge 7 is pressurized, ink in the ink pack 10 is supplied to the valve unit 6. Next, the ink temporarily stored in the valve unit 6, in a state where the pressure is regulated, is supplied to the recording head 5. Then, the printer 1, on the basis of image data, while moving the recording medium P in the sub-scanning direction by the paper feeding unit, moves the carriage 4 in the main scanning direction, and ejects ink from the recording head 5, whereby printing is performed on the recording medium P.

Next, the detailed constitution of the above ink cartridge 7 will be described with reference to FIGS. 3 and 4.

As shown in FIG. 3, the ink cartridge 7 comprises the cartridge case 9 and the ink pack 10 housed in the cartridge case 9. Further, the cartridge case 9 comprises a body case 16 as a housing body, and an upper case 18 as a lid member. In FIG. 3, only one of the six ink cartridges 7 is shown. Since the other five ink cartridges 7 has the same structure as the shown ink cartridge, their illustrations are omitted.

The ink pack 10 includes the bag part 11, and the outlet part 12. The bag part 11, in the embodiment, comprises two rectangular film members 11*a* and 11*b* as shown in FIG. 4. Each film member 11*a* and 11*b* is formed by evaporating a gas barrier layer laminated by plural layers such as polyamide synthetic fiber, and aluminum over a resin layer laminated by plural thermoplastic resin layers such as polypropylene or polyethylene. The both film members 11*a* and 11*b* are superimposed in a state where their thermoplastic resin layers face each other, the outlet part 12 is put in the center of one side of each film member with it between the both film members, and their four side edges are heat-welded, whereby their film members are bag-shaped. Namely, the bag part 11 has the gas barrier layers on its outsides.

Next, the outlet part 12 will be described. As shown in FIG. 4, the outlet part 12 includes a first pipe body 20 and a second pipe body 22, and is formed of resin that can heat-welded to the thermoplastic resin layers of the film members 11*a* and 11*b*. The second pipe body 22 is fitted into a fitting recess part 30 formed at a base end part of the first pipe body 20, and arranged inside the bag part 11 of the ink pack 10.

Figure 4:
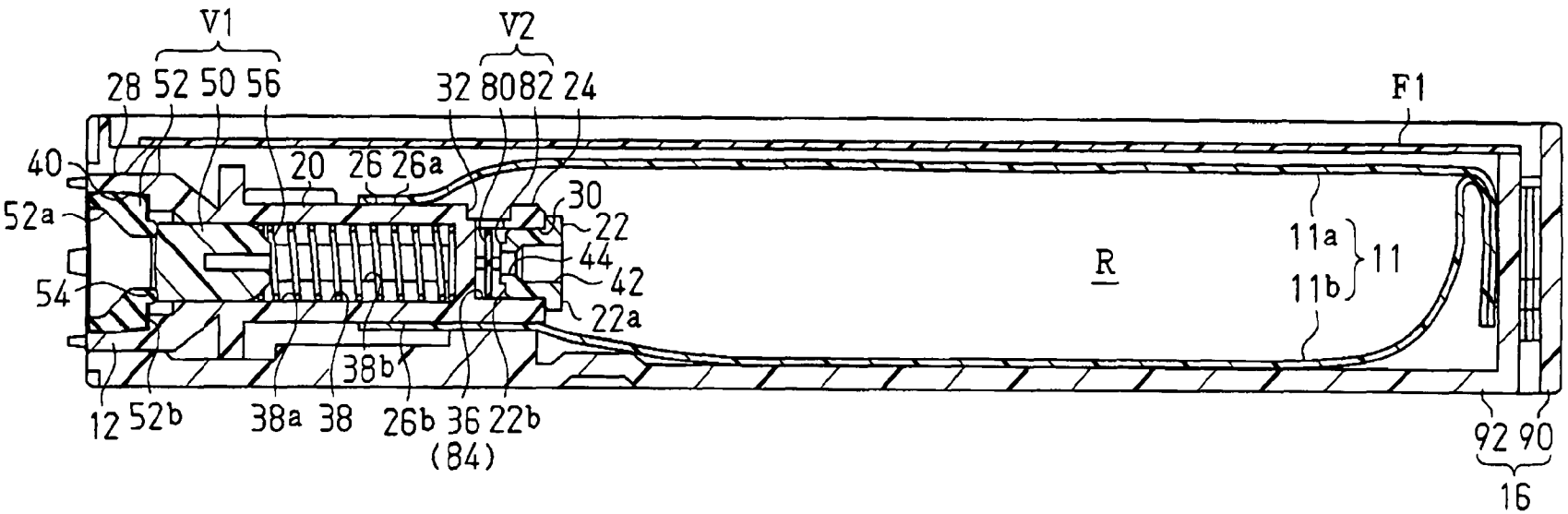
FIG. 4 is a sectional side view for explaining the constitution of the ink cartridge before blocking.

The first pipe body 20, as shown in FIG. 4, includes a fitting part 24, a welding part 26, and a cylindrical part 28. The fitting par 24 has the fitting recess part 30 inside. In the welding part 26, its peripheral surface is put between the film members 11*a* and 11*b*, and stuck to the film members 111*a* and 11*b*. Further, on an upper surface 26*a* of the welding part 26 (upper surface when the ink pack 10 is housed in the cartridge case 9), a bypass flowing passage 32 is formed.

The cylindrical part 28 is generally formed in the shape of a cylinder. In these fitting part 24, welding part 26, and cylindrical part 28, from the fitting part 24 toward the cylindrical part 28, a first communication hole 36, a second communication hole 38, and a third communication hole 40 penetrate as liquid flowing passages. The ink contained in the bag part 11 is taken out through the first communication hole 36, the second communication hole 38, and the third communication hole 40. The first communication hole 36 communicates with the bypass flowing passage 32. The second communication hole 38 has larger diameter than the first communication hole, and comprises a center hole 38*a* and plural communication grooves 38*b* formed in the center hole 38*a*. The center hole 38*a* is so formed that its section is generally circular. The communication grooves 38*b* are recessed on the inner surface of the center hole 38*a* in the axial direction. Herein, the communication grooves 38*b* are formed at two portions on the inner surface of the center hole 38*a*. The third communication hole 40 is formed in the cylindrical part 28.

Further, as shown in FIG. 4, the second communication hole 38 and the third communication hole 40 are provided with a first valve mechanism V1. The first valve mechanism V1 includes a valve body 50 and a seal member 52. The valve body 50 is provided movably in the center hole 38*a* of the second communication hole 38. The valve 50 has the outer diameter having the same size as the size of the inner diameter of the center hole 38*a*, and is provided slidably in the center hole 38*a* in the axial direction.

The seal member 52 is made of flexible material such as elastomer, and generally formed in the shape of a cylinder. An insertion hole 52*a* penetrating a center of the seal member 52 has the inner diameter on the valve body 50 side into which a hollow needle (not shown) provided for the ink supply tube 14 is tightly fitted, and is formed larger toward the discharge side. On a base end surface 52*b* of the seal member 52, a valve seat 54 is protrusively provided so as to surround an opening of the insertion hole 52*a*. The valve body 50 sits on this valve seat 54, whereby the insertion hole 52*a* of the seal member 52 is blocked by the valve body 50. The hollow needle is formed hollowly, and ink flows through its hole to the inside.

Further, the first valve mechanism V1 includes a coil spring 56 for energizing the valve body 50. The coil spring 56 is provided in the center hole 38*a* so as to energize the valve body 50 to the seal member 52 side. In case that power is not applied from the outside, as shown in FIG. 4, the coil spring 56 energizes the valve body 50 so as to bring the valve body 50 into pressure contact with the valve seat 54 of the seal member 52. When the hollow needle is inserted into the valve body 50 through the insertion hole 52*a* of the seal member 54, the valve body 50 moves against the energizing power of the coil spring 56 in a direction separating from the seal member 52. At this time, the leading end of the hollow needle is inserted in a state where it is sealed by the seal member 52. Further, when the valve body 50 separates from the seal member 52, the hole of the hollow needle connects through the communication groove 38*b* to the center hole 38*a* on the opposite side with the valve body 50 between. Therefore, when the ink in the bag part 11 is introduced into the second communication hole 38 through the first communication hole 36, the ink is introduced through the communication groove 38*b* to the center hole 38*a* on the seal member 52 side with the valve body 50 between, and it flows from the hole of the hollow needle to the ink supply tube 14. Namely, when the ink cartridge 7 is attached to the cartridge holder 2*a*, the hollow needle is inserted into the seal member 52, and the ink is supplied through the ink supply tube 14 to the valve unit 6.

The second pipe body 22 fitted and fixed into the fitting recess part 30 formed at the base end part of the first pipe body 20 has a fourth communication hole 42 and a fifth communication hole 44, which continue from a base end surface 22*a* of the second pipe body 22 toward a leading end surface 22*b* thereof as liquid flowing passages. The inner diameter of the fourth communication hole 42 is formed larger than that of the fifth communication hole 44.

In the first communication hole 36 on the first valve mechanism V1 side from the leading surface 22*b* of the second pipe body 22, a second valve mechanism V2 is provided as a check valve. The second valve mechanism V2 comprises a valve body 80 and a valve seat 82. The valve body 80 is generally disc-shaped, which has such size that an opening of the fifth communication hole 44 of the second pipe body 22 can be blocked. The valve seat 82 is formed independent of the valve body 80, and is annularly protruded, on the leading end surface 22*b* of the second pipe body 22, around the opening part of the fifth communication hole 44. Therefore, when the valve body 80 comes into contact with the valve seat 82, it closes the fifth communication hole 44.

Further, by welding the whole of the welding part 26 of the first pipe body 20 with the film members 11*a* and 11*b*, the bypass flowing passage 32 formed on the upper surface 26*a* is blocked by the film member 11*a* as a blocking means. By blocking the bypass flowing passage 32, in the first communication hole 36 which communicates with the bypass flowing passage 32 and houses the valve body 80 therein, a valve body housing room 84 is formed. In result, in the valve body housing room 84, the valve body 80 reciprocates in the axial direction by pressure difference between the fluid in the fifth communication hole 44 and the fluid in the first communication hole 36. Specifically, when the fluid (for example, ink or air) moves from the first communication hole 36 to the fifth communication hole 44 (in a direction where the ink is poured in the bag part 11), or when the pressure of the fluid in the fifth the communication hole 44 becomes lower than the pressure of the fluid in the first communication hole 36, the valve body 80 moves toward the valve seat 82. Then, the valve body 80 comes into contact with the valve seat 82, and shuts off the flow of the fluid from the first communication hole 36 to the fifth communication hole 44.

In the ink pack 10 of the embodiment, the film member 11*a* is welded to the welding part 26 so that the bypass flowing passage 32 is not blocked by the film member 11*a* till ink is filled into the bag part 11. Hereby, the ink supplied to the first communication hole 36 through the first valve mechanism V1 is filled through the bypass flowing passage 32 into the bag part 11. When the ink is filled into the bag part 11, the film member 11*a* is welded to the welding part 26 so that the bypass flowing passage 32 is blocked.

On the other hand, in case that the ink is discharged from the bag part 11, the pressure of the ink in the fifth communication hole 44 becomes larger than the pressure of the ink in the first communication hole 36, and the valve body 80 separates from the valve seat 82. In result, the ink can flow from the fifth the communication hole 44 to the first communication hole 36. Namely, the second valve mechanism V2 permits the flow of the fluid from the fifth the communication hole 44 to the first communication hole 36, and functions as a check valve which shuts off the reverse flow. Accordingly, when the ink pack 10 is pressed from the outside by the pressure air, the pressure of the ink in the fifth communication hole 44 becomes higher than the pressure of the ink in the first communication hole 36, the valve body 80 of the second valve mechanism V2 separates from the valve seat 82, and the inside of the bag part 11 communicates with the hole of the hollow needle. Further, when the user pushes the valve body 50 of the first valve mechanism V1 into the inside using a jig, the air flows through the seal member 52, so that the pressure in the first communication hole 36 becomes high. Then, the valve body 80 is brought into pressure contact with the valve seat 82, and it is possible to prevent the air from flowing into the bag part 11.

Next, the cartridge case 9 comprising the body case 16 and the upper case 18 will be described. As shown in FIG. 3, the body case 16 has double structure comprising an outer case 90 and an inner case 92, and their cases are made of, for example, polypropylene respectively. The outer case 90 is formed generally in the shape of a rectangular parallelepiped, and it is a box body of which the upside is opened. The inner case 92 is smaller than the outer case 90, is shaped like the ink pack 10, and regulates the movement of the ink pack 10 corresponding to the movement of the cartridge case 9.

In the center of a front surface 94 of the body case 16 (outer case 90), a square outlet part-attaching part 96 is formed. For the outlet part-attaching part 96, an opening part 98 communicating with the inner case 92 is provided. On one side of the outlet part-attaching part 96, an air inlet H is formed. The air inlet H communicates the outside of the body case 16 (outer case 90) and the inside of the inner case 92. Further, on a front inner side of the inner case 92, a pair of left and right outlet part fixing ribs 100 between which the outlet part 12 is interposed are formed. An end part 102 of the outlet part fixing rib 100 is fitted to an annular projection 104 formed at the periphery of the outlet part 12 (cylindrical part 28) in the shape of a disc thereby to fix the outlet part 12 of the ink pack 10 to the body case 16.

At the bottom of the inner case 92, and between a pair of left and right outlet part fixing ribs 100, a turn preventing member 106 is formed. The turn preventing member 106 is a projection which fits to a recess part (not shown) formed at the cylindrical part 28 of the outlet part 12, and regulates the movement in the turn direction of the ink pack thereby to position the ink pack 10 in the predetermined position. When the ink pack 10 is housed in the cartridge case 9, it is housed in the inner case 92 so that the outlet part 12 of the ink pack 10 is exposed from the inside of the opening part 98 to the outside.

In the embodiment, in case that the ink pack 10 is housed and fixed into the inner case 92, it is housed in a state where ink is not filled into the bag part 11. Accordingly, the ink pack 10 is housed in the inner case 92 in a state where the bypass flowing passage 32 of the outlet part 12 is not blocked by the film member 11*a*.

When the ink pack 10 into which ink has not been filled yet is housed in the inner case 92, a first seal film F1 as a seal member made of polypropylene and having flexibility is heat-welded to the inner case 92. Hereby, the opening part of the inner case 92 is blocked by the first seal film F1 in the state where the ink pack 10 is housed in the inner case 92. Further, to the outlet part attaching part 96 on the front surface of the outer case 90, after the ink has been filled into the ink pack 10, a second seal film F2 made of polypropylene is heat-welded. Accordingly, the opening part 98 and the opening part of the outlet part 12 are closed airtightly by the second seal film F2. Further, by the second seal film F2, a gap between the opening part 98 and the outlet part 12 is sealed. In result, space S formed by the inner case 92 in which the ink pack 10 is housed, and the first and second seal films F1 and F2, is in an airtight state except for the air inlet H. Therefore, air supplied from the air inlet H into the inner case 92 by the air pressure pump 8 (refer to FIG. 1) supported by the frame 2, since the inner case 92 is kept airtight, pressurizes the ink pack 10 housed in the space S.

The upper case 18 is composed of a generally square plate-shaped member which is put on the upper surface of the body case 16, and it is formed of, for example, polypropylene. The upper case 18 has fixing pieces K1 at the predetermined portions. When the upper case 18 is put on the upper surface of the body case 16, the fixing piece K1 is fitted to a fitting member K2 formed between the outer case 90 and the inner case 92. The opening part of the body case 16 is blocked by the upper case 18, whereby the cartridge case 9 is formed.

Figure 5:
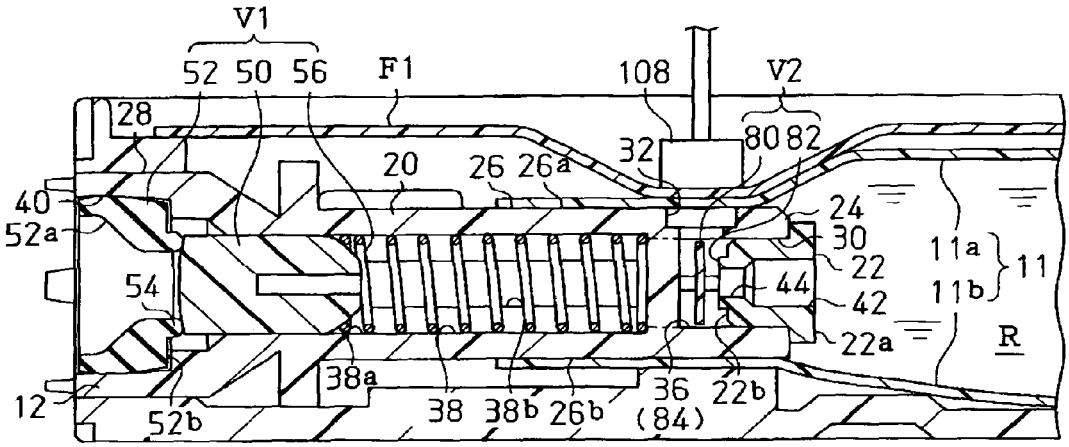
FIG. 5 is a sectional side view for explaining a blocking method of the ink cartridge.
Figure 6:
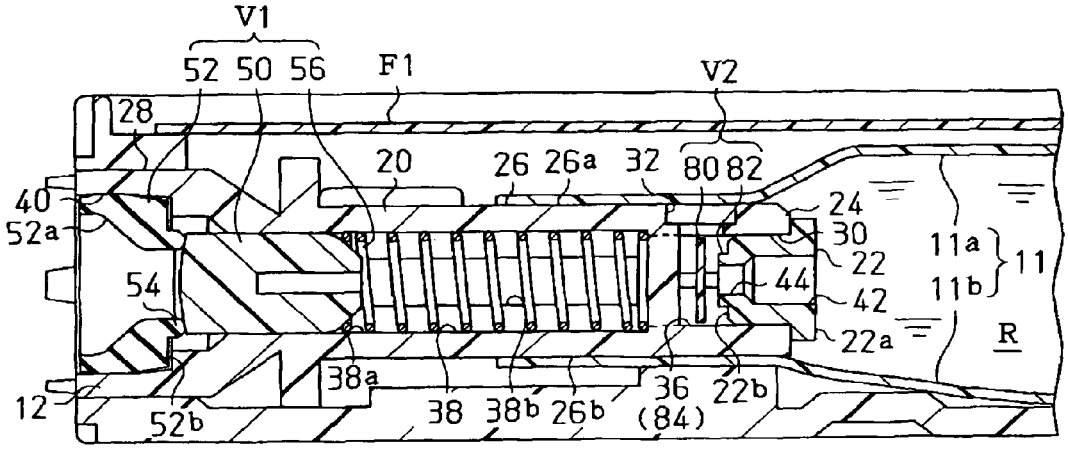
FIG. 6 is a sectional side view for explaining the constitution of the ink cartridge after blocking.

Next, a method of manufacturing the thus constructed ink pack 10 will be described with reference to FIGS. 4 to 6.

As shown in FIG. 4, the ink pack 10 is housed in the inner case 92 of the body case 16 (housing step), and the inner case 92 is closed airtightly by the first seal film F1 (airtightly closing state). At this time, ink has not been filled yet in an inner space R of the ink pack 10. The upper surface 26*a* of the heat-welding part 26 of the outlet part 12 has not been completely heat-welded to the film member 11*a*, and only the lower surface 26*b* has been heat-welded to the film member 11*b*. Therefore, the bypass flowing passage 32 provided for the upper surface 26*a* of the welding part 26 of the outlet part 12 has not been sealed by the film member 11*a* yet. In result, in the ink pack 10 before ink filling, the valve body housing room 84 for housing the valve body 80 has not been formed yet. Therefore, the inner space R of the bag part 11, even not through the fifth communication hole 44, communicates with the bypass flowing passage. At this time, the opening part 98 of the body case 16 is not sealed by the second seal film F2. Accordingly, the inner space R of the bag part 11, without passing through the second valve mechanism V2, can communicate with the second and third communication holes 38 and 40 of the outlet part 12. In result, in this ink pack 10 before assembly, not only flow of the fluid from the inside of the bag part 11 to the outside but also flow of the fluid from the outside of the bag part 11 to the inside is permitted.

Next, into the insertion hole 52*a* of the seal member 52 provided for the first pipe body 20 of the outlet part 12, the hollow needle provided for the leading end of the ink filling tube (not shown) is inserted. Then, by the hollow needle, the valve body 50 moves against the energizing power of the coil spring 56 in the direction separating from the seal member 52. Therefore, the hole of the hollow needle and the center hole 38*a* on the opposite side with the valve body 50 between are connected through the communication groove 38*b*. In this state, ink is introduced from the ink filling tube (not shown) to the outlet part 12. The filling ink flows through the communication groove 38*b* into the center hole 38*a* on the coil spring 56 side. The filling ink that has flown into the center hole 38*a* on the coil spring 56 side is supplied through the first communication hole 36 and the bypass flowing passage 32 into the bag part 11 (filling step).

After the bag part 11 has been full of the ink, when the hollow needle of the ink filling tube is pulled out from the seal member 52, the ink filling work into the ink pack 10 is completed, and a next work proceeds to a blocking step. In the blocking step, as shown in FIG. 5, in order to close the bypass flowing passage 32 by a heat-welding member 108 such as a heater, the film member 11*a* is heat-welded to the upper surface 26*a* of the welding part 26 from the upside of the first seal film F1 (blocking state). At this time, since the first seal film F1 has flexibility, even in case that the heat-welding member 108 pushes against the first seal film, the first seal film only yields and does not break. The inside (welding part 26 side) of the film member 11*a* and the welding part 26, since they are formed of the same material, for example, the thermoplastic resin layer respectively, are heat-welded to each other. On the other hand, though the first seal film F1 is formed of, for example, the thermoplastic resin layer, the outside of the film member 11*a* is formed of, for example, the gas barrier layer. Namely, since the outside of the film member 11*a* and the first seal film F1 are formed of different materials, they are not heat-welded to each other. Therefore, as shown in FIG. 6, the inside of the film member 11*a* and the upper surface 26*a* of the welding part 26 are heat-welded, and the bypass flowing passage 32 is blocked. Further, since the first seal film F1 is not heat-welded to the outside of the film member 11*a*, the first film F1 and the ink pack 10 (film member 11*a*) are, in a state where they are not fixed to each other, housed into the inner case 92.

When the blocking step ends, the upper case is put on the upper surface of the body case 16. At this time, the fixing piece K1 provided for the upper case 18 and the fitting member K2 formed between the outer case 90 and the inner case 92 are fitted. Lastly, the opening part 98 of the body case 16 is sealed by the second seal film F2, whereby the ink cartridge 7 in which the ink pack 10 is housed in the cartridge case 9 is finished.

According to the embodiment, the following advantages can be obtained.

(1) According to the embodiment, after the ink pack 10 in which ink has not been yet filled into the bag part 11 has been housed in the inner case 92 (body case 16), the ink is filled into the ink pack 10. Therefore, the following problem like that in the conventional case is not produced: in case that the first seal film F1 is welded after the ink pack filled with the ink has been housed in the case, the bag part filled with the ink is bulky, so that the ends of the bag part 11 stick from the cartridge case 9 and are caught in the cartridge case 9. Further, since there is no fear that the ends of the bag part 11 stick from the cartridge case 9, the maximum amount of ink for the inside volume of the cartridge case 9 can be filled.

(2) According to the embodiment, after the ink pack 10 into which ink has not been yet filled has been housed in the inner case 92, the ink is filled into the ink pack 10. In result, in assembly of the printer 1, it is not necessary to previously prepare the ink pack 10 filled with each color of ink. Therefore, the number of assembly steps of the printer 1 can be reduced.

(3) According to the embodiment, after the ink pack 10 into which ink has not been yet filled has been housed in the inner case 92, the ink is filled into the ink pack 10. In result, in assembly of the printer 1, it is not necessary for a worker to deal with the ink pack 10 filled with the ink. Therefore, in assembly of the printer 1, it is prevented that the worker breaks the ink pack 10 filled with the ink erroneously.

(4) According to the embodiment, after the ink pack 10 into which ink has not been yet filled has been housed in the inner case 92, the ink is filled into the ink pack 10. In result, the kind of color of the ink cartridge 7 can be determined when the ink is filled into the ink pack 10. Therefore, it is possible to prevent the kind of color of the ink cartridge 7 shown on the ink cartridge 7 from differing from the kind of color of the ink actually filled into the ink pack 10 housed in the ink cartridge 7.

(5) According to the embodiment, the bypass flowing passage 32 is provided for the outlet part 12. Therefore, though the second valve mechanism V2 exists, the ink can be poured from the outlet part 12 to the bag part 11.

(6) According to the embodiment, the bypass flowing passage 32 is blocked after the ink has been filled into the ink pack 19. Therefore, contamination of air bubbles into the bag part 11 due to the erroneous operation by the user can be prevented.

(7) According to the embodiment, the bag part 11 and the outlet part 12 (bypass flowing passage 32) are heat-welded. Therefore, for example, compared with the case of vibration welding, it is possible to prevent cleaning level of ink from lowering due to contamination of dust in the bag part 11. Further, for example, compared with the case of vibration welding, time necessary for welding can be reduced.

(8) According to the embodiment, the outlet part 12 and the inside of the bag part 11 are formed of the same materials, while the outside of the bag part 11 and the first seal film F1 are formed of the different materials. In result, even in case that heat-welding is performed form the upside of the first seal film F1, the bag part 11 and the first seal film F1 are not bonded, but the bag part 11 and the outlet part 12 are bonded. Therefore, by the simple method, without adding a blocking member, the bypass flowing passage 32 can be blocked.

Second Embodiment

Next, a second embodiment of the invention will be described with reference to FIGS. 7 and 8. This embodiment is characterized by a blocking method of the bypass flowing passage 32 of the ink pack 10 described in the first embodiment. In the following description, the same parts as those in the first embodiment are denoted by the same reference characters, and their detailed descriptions are omitted.

Figure 7:
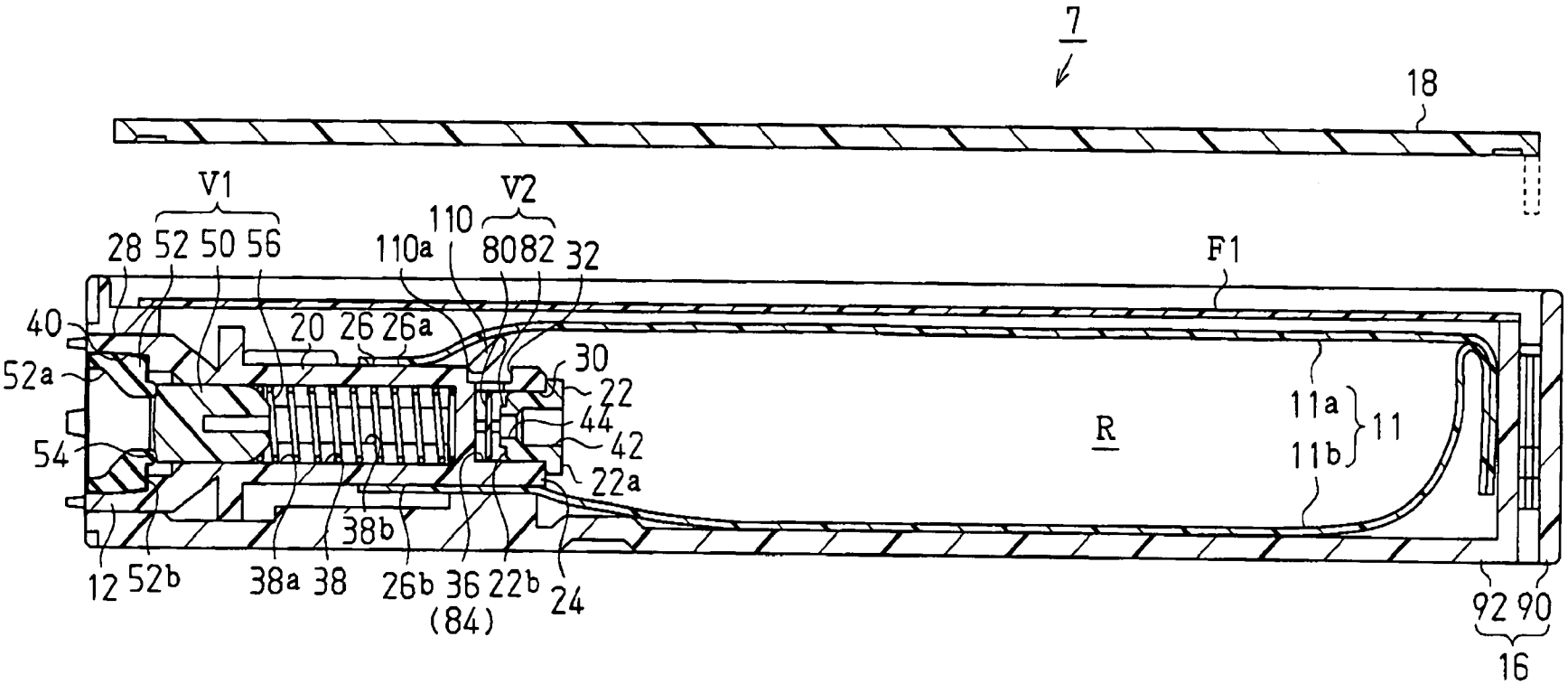
FIG. 7 is a sectional side view for explaining the constitution of an ink cartridge before blocking in a second embodiment.
Figure 8:
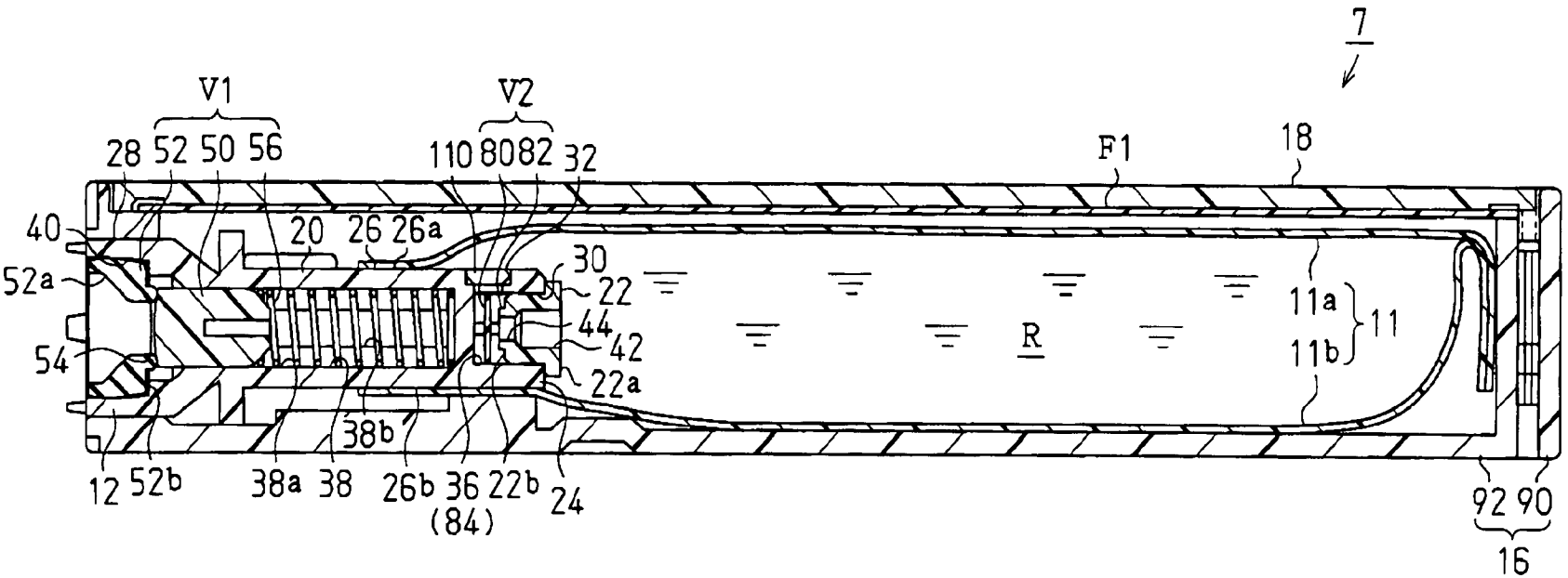
FIG. 8 is a sectional side view for explaining the constitution of the ink cartridge after blocking.

As shown in FIG. 7, in the ink pack 10 before the ink is filled, a blocking means, that is, a blocking member 110 as a stopper is coupled to the outlet part 12 rotatably in relation to the opening part of the bypass flowing passage 32. The blocking member 110 is coupled through a coupling part 110*a* to the outlet part 12, and rotates about the coupling part 110*a*. The blocking member 110 is usually arranged in a position where the bypass flowing passage 32 is opened. When the blocking member 110 is pressed from the upside, it rotates about the coupling part 110*a*, and fitted and fixed to the bypass flowing passage 32 thereby to close the bypass flowing passage 32.

When ink is filled into the ink pack 10, as shown in FIG. 7, the blocking member 110 is opened, and the ink is filled similarly to in the first embodiment (filling step).

After the ink has been filled into the ink pack 10, the next work proceeds to a blocking step. In the blocking step, using a pressing jig or a finger, as shown in FIG. 8, the blocking member 110 is fitted and fixed to the bypass flowing passage 32 through the film member 11*a* from the upside of the first seal film F1 thereby to close the bypass flowing passage 32 (blocking step). At this time, since the first seal film F1 has flexibility, even in case that the jig or the figure pushes against the first seal film, the first film only yields and does not break. In the embodiment, the film member 11*a* is not heat-welded to the welding part 26 (bypass flowing passage 32), which is different from the case in the first embodiment.

The fixing piece K1 provided for the upper case 18 and the fitting member K2 formed between the outer case 90 and the inner case 92 are fitted. Hereby, the ink cartridge 7 in which the ink pack 10 is housed in the cartridge case 9 is finished.

According to the embodiment, in addition to the advantages in the first embodiment, the following advantages can be obtained.

(1) According to the embodiment, before ink filling, the blocking member 110 is in the open position, and the bypass flowing passage 32 of the ink pack 10 is opened. After the ink has been filled into the ink pack 10, the blocking member 110 is fitted and fixed to the bypass flowing passage 32 thereby to close the bypass flowing passage 32. Therefore, in the embodiment, since the bypass flowing passage 32 can be blocked without performing heat welding, the blocking work can be performed more easily and with the reduced number of steps.

Further, the above each embodiment may be changed as follows:

In the first embodiment, after the bypass flowing passage 32 has been blocked, the upper case 18 is put on the upper surface of the body case 16. This may be changed as follows: An opening part for heat-welding is formed at a portion of the upper case 18 opposed to the bypass flowing passage 32; the upper case 18 is put on the upper surface of the body case 16; thereafter the bypass flowing passage 32 is blocked by the heat-welding member 108 from the upside of the above opening part; and lastly, the opening part is blocked.

In the second embodiment, the blocking member 110 is coupled to the outlet part 12 rotatably. This may be changed as follows: The blocking member is loosely fitted to the bypass flowing passage 32; and after the ink has been filled into the ink pack 10, the blocking member is deeply driven into the bypass flowing passage 32, whereby the blocking member is fitted to the bypass flowing passage 32.

In each embodiment, the first seal film F1 has flexibility as a whole. However, the first seal film F1 may have flexibility at least at only the part opposed to the bypass flowing passage 32.

In each embodiment, though the number of the ink packs 10 is six, the number of the ink packs 10 mounted on the printer 1 may be any number.

In each embodiment, though the liquid jet apparatus is embodied in the printer 1, the invention is not limited to this, but may be applied to other liquid jet apparatuses which jet other liquid. For example, a liquid jet apparatus which jets liquid such as electrode material or color material used in manufacture of a liquid crystal display, an EL display or a surface light emitting display; a liquid jet apparatus which jets a bioorganic matter used in manufacture of a biochip; and a sample jet apparatus as a precise pipette may be used.

What is claimed is:

1. A method of manufacturing a liquid container, the liquid container having a liquid storing member including a liquid containing part that contains liquid therein, and an outlet member attached to the liquid containing part so that the liquid contained in the liquid containing part can be supplied from the outlet member to an outside, and a housing including a housing body and a lid member that closes the housing body so that the liquid storing member is housed in the housing body, wherein the outlet member includes a liquid flowing passage which communicates the outside with an inside of the liquid containing part, a check valve which is disposed in the liquid flowing passage and which only permits a flow of the liquid from the inside of the liquid storing member to the outside when the liquid is supplied from the outlet member to the outside, and a bypass flowing passage which is disposed in the liquid flowing passage and through which a flow of liquid bypasses the check valve to communicate the outside with the inside of the liquid containing part, the method comprising the steps of:

housing the liquid storing member in the housing body;

after the housing of the liquid storing member in the housing body, filling the liquid from the outside into the liquid containing part by causing the liquid to flow through the liquid flowing passage of the outlet member and through the bypass flowing passage into the liquid storing member; and blocking, after filling a predetermined amount of the liquid into the liquid containing part, the bypass flowing passage with a blocking structure.

2. A method of manufacturing a liquid container, the liquid container comprising:

a liquid storing member including a liquid containing part that contains liquid therein, and an outlet member attached to the liquid containing part so that the liquid contained in the liquid containing part can be supplied from the outlet member to an outside; and a housing including a housing body and a lid member that closes the housing body so that the liquid storing member is housed in the housing body, wherein:

the outlet member includes: a liquid flowing passage which communicates the outside with an inside of the liquid containing part; a check valve which is disposed on the liquid flowing passage and which permits only a flow of the liquid from the inside to the outside when the liquid is supplied from the outlet member to the outside; and a bypass flowing passage which is disposed on the liquid flowing passage and which bypasses the check valve to communicate the outside with the inside of the liquid containing part;

the method comprising the steps of:

housing the liquid storing member in the housing body;

filling the liquid from the outside into the liquid containing part through the liquid flowing passage of the outlet member and the bypass flowing passage;

blocking, after filling the liquid into the liquid containing part, the bypass flowing passage by blocking means; and an air tightly closing step of closing the housing body by a seal member airtightly after the step of housing the liquid storing member into the housing body, wherein the seal member has flexibility at least at its portion opposed to a blocking position where the bypass flowing passage is blocked, and the blocking means is the liquid containing part.

3. The liquid container manufacturing method according to claim 2, wherein surfaces of the seal member and the liquid containing part are formed of materials different from each other, the surfaces of the seal member and the liquid containing part being opposed to each other.

4. A method of manufacturing a liquid container, the liquid container comprising:

a liquid storing member including a liquid containing part that contains liquid therein, and an outlet member attached to the liquid containing part so that the liquid contained in the liquid containing part can be supplied from the outlet member to an outside; and a housing including a housing body and a lid member that closes the housing body so that the liquid storing member is housed in the housing body, wherein:

the outlet member includes: a liquid flowing passage which communicates the outside with an inside of the liquid containing part; a check valve which is disposed on the liquid flowing passage and which permits only a flow of the liquid from the inside to the outside when the liquid is supplied from the outlet member to the outside; and a bypass flowing passage which is disposed on the liquid flowing passage and which bypasses the check valve to communicate the outside with the inside of the liquid containing part;

the method comprising the steps of:

housing the liquid storing member in the housing body;

filling the liquid from the outside into the liquid containing part through the liquid flowing passage of the outlet member and the bypass flowing passage; and blocking, after filling the liquid into the liquid containing part, the bypass flowing passage by blocking means, wherein blocking of the bypass flowing passage is performed by heat welding.

5. A method of manufacturing a liquid container, the liquid container comprising:

a liquid storing member including a liquid containing part that contains liquid therein, and an outlet member attached to the liquid containing part so that the liquid contained in the liquid containing part can be supplied from the outlet member to an outside; and a housing including a housing body and a lid member that closes the housing body so that the liquid storing member is housed in the housing body, wherein:

the outlet member includes: a liquid flowing passage which communicates the outside with an inside of the liquid containing part; a check valve which is disposed on the liquid flowing passage and which permits only a flow of the liquid from the inside to the outside when the liquid is supplied from the outlet member to the outside; and a bypass flowing passage which is disposed on the liquid flowing passage and which bypasses the check valve to communicate the outside with the inside of the liquid containing part;

the method comprising the steps of:

housing the liquid storing member in the housing body;

filling the liquid from the outside into the liquid containing part through the liquid flowing passage of the outlet member and the bypass flowing passage; and blocking, after filling the liquid into the liquid containing part, the bypass flowing passage by blocking means, wherein the blocking means is a stopper fitted and fixed to the bypass flowing passage.

6. A method of manufacturing a liquid container, the method comprising:

(a) preparing a liquid storing member and a housing body formed with an opening and an air inlet port, the liquid storing member including:

a liquid containing part formed by a film member; and a liquid outlet member welded to the film member, the liquid outlet member including:

a liquid flowing passage configured to communicate an inside of the liquid containing part with an outside of the housing body;

a check valve disposed in the liquid flowing passage and configured to allow liquid to flow from the inside of the liquid containing part to the outside; and a bypass flowing passage communicating the inside of the liquid containing part to the outside while bypassing the check valve;

(b) accommodating the liquid storing member in the housing body so that the liquid outlet member is inserted into the opening;

(c) welding a first film on an inner case of the housing body, so that the liquid storing member is accommodated into a space defined by the inner case and the first film, and that the space is communicated with the air inlet port;

(d) injecting liquid into the inside of the liquid containing part from the outside through the bypass flowing passage;

(e) welding the film member to the liquid outlet member to block the bypass flowing passage after the steps (a)-(d);

(f) welding a second film to the housing body to seal a gap between the opening and the liquid outlet member; and (g) attaching a cover to the housing body so as to cover the first film.

* * * * *